United States Patent [19]

Bittner

[11] Patent Number: 4,706,440

[45] Date of Patent: Nov. 17, 1987

[54] METHOD AND APPARATUS FOR PACKAGING EXPANSILE ARTICLES

[75] Inventor: Charles W. Bittner, Haddonfield, N.J.

[73] Assignee: Precision Automation Co., Inc., Haddonfield, N.J.

[21] Appl. No.: 939,785

[22] Filed: Dec. 9, 1986

[51] Int. Cl.[4] ..... B65B 63/02

[52] U.S. Cl. ..... 53/438; 53/475; 53/530; 53/258

[58] Field of Search ..... 53/258, 438, 530, 473, 53/475, 572, 439, 115, 436, 447, 459, 523, 526, 528

[56] References Cited

U.S. PATENT DOCUMENTS

| | | | |
|---|---|---|---|
| 3,179,131 | 4/1965 | Kissling | 53/530 X |
| 3,340,129 | 9/1967 | Grevich . | |
| 3,783,578 | 1/1974 | Willis et al. | 53/438 |
| 3,962,845 | 6/1976 | Mojden et al. | 53/254 X |
| 4,018,031 | 4/1977 | Smaw | 53/572 X |
| 4,062,169 | 12/1977 | Lister et al. | 53/258 X |
| 4,103,473 | 8/1978 | Bast et al. . | |
| 4,203,269 | 5/1980 | Petersen | 53/258 X |
| 4,352,263 | 10/1982 | Andrews | 53/258 X |
| 4,506,494 | 3/1985 | Shimoyama et al. . | |
| 4,532,753 | 8/1985 | Kovacs . | |
| 4,571,926 | 2/1986 | Scully . | |
| 4,586,314 | 5/1986 | Monge et al. | 53/530 X |
| 4,592,193 | 6/1986 | Gustavsson | 53/530 |

FOREIGN PATENT DOCUMENTS 1334616 10/1973 United Kingdom .

*Primary Examiner*—Robert L. Spruill
*Assistant Examiner*—Steven P. Weihrouch
*Attorney, Agent, or Firm*—Robert K. Youtie

[57] ABSTRACT

A method and apparatus for packaging radially expansile articles by passing a succession of such articles in generally coaxially aligned engaging relation with each other through a tubular guide which retains the articles against expansion, sequentially discharging the end most article into a second tubular guide sized to permit limited radial expansion of the received article, extending an engaging member into the second guide to displace each successively discharged article away from the first guide to enable unobstructed discharge and expansion of the next end most article, and engaging the last discharged article to displace it and a predetermined number of previously discharged articles out of the second guide for bagging.

10 Claims, 7 Drawing Figures

FIG. 4
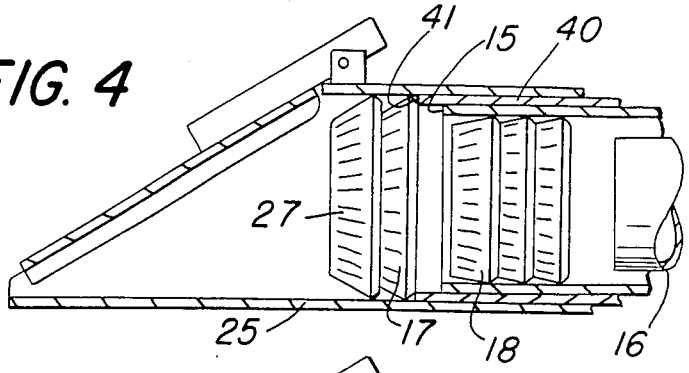
FIG. 5
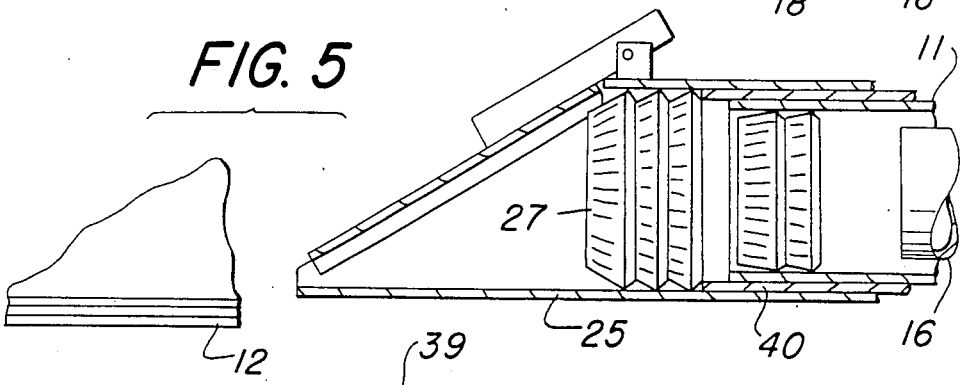
FIG. 6
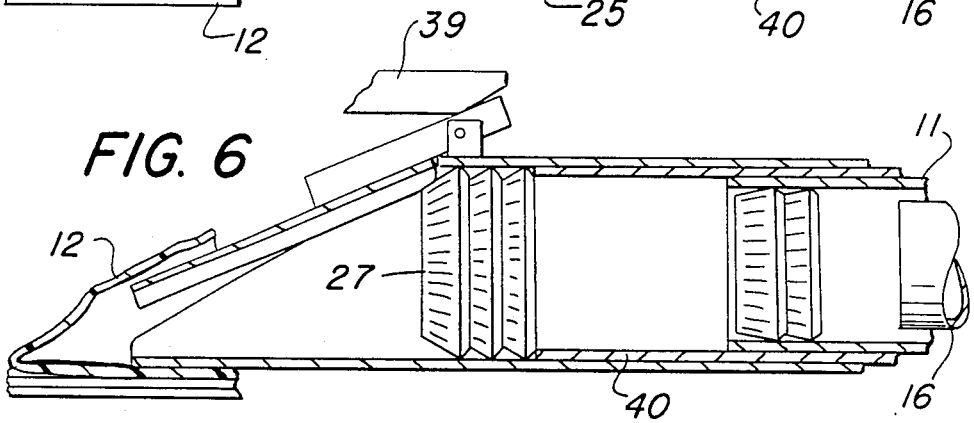
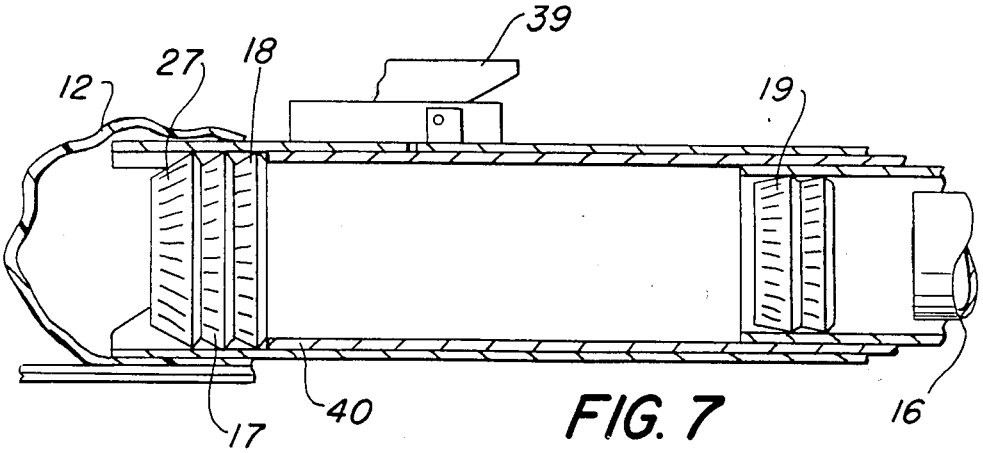
FIG. 7

METHOD AND APPARATUS FOR PACKAGING EXPANSILE ARTICLES

BACKGROUND OF THE INVENTION

While the method and apparatus of the present invention are primarily concerned with the packaging of coffee filters, say the conventional dished or cup shaped paper filters for coffee makers, and will be illustrated and described hereinafter with particular reference thereto, it is appreciated that the instant invention is capable of many varied applications, as in the packaging or other processing of various radially expansile articles, all of which applications are intended to be comprehended herein.

Applicant is aware of the below listed prior patents:

| U.S. PAT. NO. | DATE | PATENTEE |
|---|---|---|
| 4,098,177 | July 4, 1978 | Olney et al. |
| 4,094,234 | June 13, 1978 | Olney et al. |
| 3,962,845 | June 15, 1976 | Mojden et al. |

The prior patents to Olney et al. are concerned with the manufacture of coffee filters, illustrating a type of machine to which applicant's instant invention is applicable. The patent to Mojden illustrates automatic bagging of stacked can ends, but is not pertinent to applicant's instant invention utilizing the resiliently expansile nature of the product being processed.

SUMMARY OF THE INVENTION

It is an important object of the present invention to provide a method and apparatus for packaging coffee filters, or other similar resiliently expansile articles, the articles are received from the production machinery in a constraining tube or guideway, successively discharged therefrom to a larger tube or guideway permitting partial expansion into and resilient holding engagement with the larger guideway, and an engaging member is extendable into a larger guideway for displacing an article away from the first mentioned guideway to enable the next adjacent article to move into and expand within the larger guideway, without obstruction.

The present invention further contemplates the displacement of a predetermined number of articles into the larger guideway by a predetermined number of extensions of the engaging member, and subsequent extension of the engagement member to discharge the predetermined number of articles from the larger guideway.

It is a further object of the present invention to provide a method and apparatus for use in packaging coffee filters and like articles, which are extremely simple in operation and construction, entirely reliable in use, and effect a substantial savings in costs.

Other objects of the present invention will become apparent upon reading the following specification and referring to the accompanying drawings, which form a material part of this disclosure.

The invention accordingly consists in the factures of construction, combinations and arrangements of parts and method steps which will be exemplified in the following description, and of which the scope will be indicated by the appended claims.

BRIEF DESCRIPTION OF THE DRAWINGS

FIGS. 3, 4, 5, 6 and 7 are all similar to FIG. 2, and respectively illustrate successive stages in practice of the instant invention.

A DESCRIPTION OF THE PREFERRED EMBODIMENT

Figure 1:
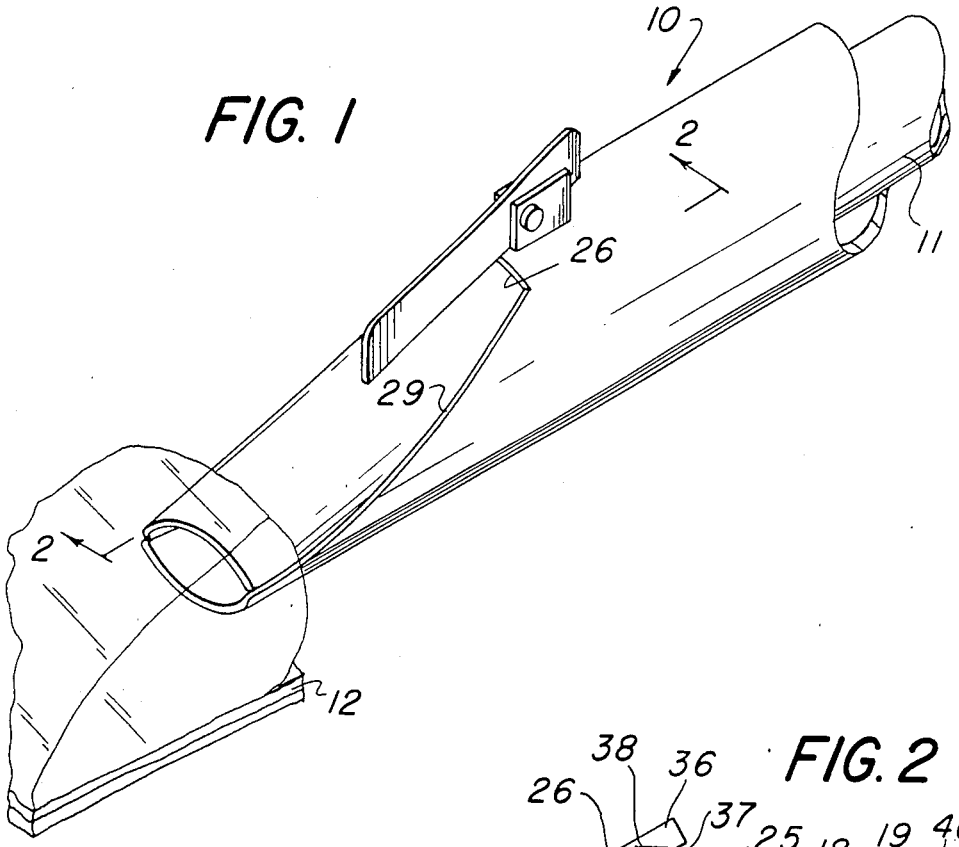
FIG. 1 is a top perspective view showing apparatus of the present invention adapted for use with a coffee filter making machine and a bagging machine.

Referring now more particularly to the drawings, and specifically to FIG. 1 thereof, a packaging device of the present invention is there generally designated 10, and illustrated as applied to the outlet or discharge tube 11 from a conventional coffee filter maker, such as a horizontal stamping machine. Downstream (leftward in FIG. 1) of the packaging apparatus there are shown a stack of bags 12, which may be carried by a bag elevator of a conventional bag opening machine, such as the type that blows open a bag for insertion of contents in the opened bag.

Figure 2:
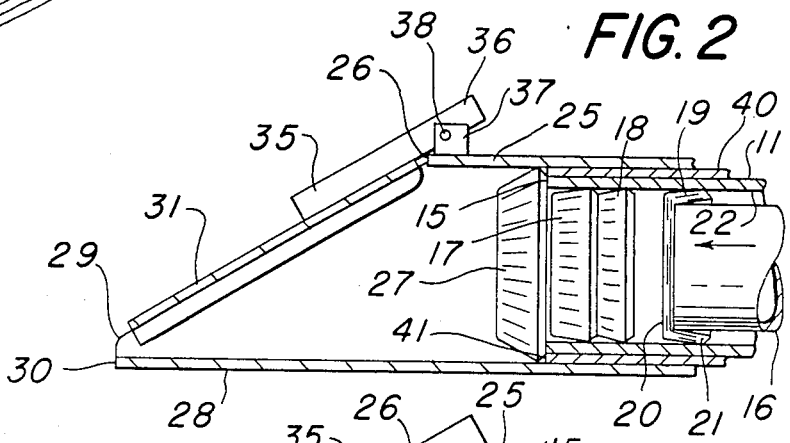
FIG. 2 is a partial sectionally elevational view taken generally along the line 2—2 of FIG. 1, illustrating an early operative condition in practice of the instant invention.

In FIG. 2, it is seen that the discharge tube 11, which may be generally cylindrical, extends from a coffee filter making machine (not shown) and terminates at an open outlet or discharge end 15. Also part of the coffee filter making machine is a plunger 16 movable longitudinally in the tube 11. A series or row of filter packs are shown, as at 17, 18 and 19. The filter packs each consisting of a quantity of coffee filters of dished or cupped configuration, in nested relation. In practice, a quantity of fifty filters may be nested together in each pack. As best seen in FIG. 2, the pack 19 includes a generally circular bottom wall 20, and a circumferential sidewall 21 extending about the bottom wall and rearwardly, inwardly or rightwardly therefrom, as seen in FIG. 2. The bottom wall 20 may have a diameter slightly less than the interior diameter of the cylindrical passageway or guide tube 11, and the circumferential side wall 21, by the resilience of the filter material, may be yieldably urged radially outwardly into frictional engagement with the interior cylindrical surface 22 of the passageway or guide 11.

While the plunger 16 may be remote from its illustrated position in the drawings, it is intended to illustrate a feeding means for passing the cup-like, radially, resiliently expansile articles 17, 18 and 19 longitudinally through the tubular guide or passageway 11. That is, the radially expansile articles 17–19 may be generally coaxially aligned with each other and the tube or guide 11 and in abutting engagement with each other for simultaneous movement of the several articles sequentially along the passageway.

As seen in FIG. 2, the cylindrical tube or passageway 11 has its outlet or opening 15 opening into the interior of a larger, generally concentric, cylindrical passageway or tube 25. The larger, outer cylindrical tube or guide 25 extends beyond the outlet end 15 of the inner, smaller tube 22, coaxially therewith, to a transverse edge 26. The length of outer, larger guide or passageway 25 between the outlet 15 of inner tube 11 and the edge 26 of the outer tube is approximately of a length to receive a selected quantity of articles to be packaged. For example, in the illustrated embodiment there are being packaged three packs or quantities of filter papers, such as the packs 18, 17 and 27, as will appear presently.

The guide or tube 25 extends beyond the edge 26, as at 28, and is there obliquely cut away, as at 29. That is, a cut-out 29 extends from the edge 26 on the upper side of the tube 25 obliquely downwardly and outwardly to the end edge 30 at the lower region of the tube. Thus, the cut-out 29 leaves an outwardly tapering, generally right triangular remaining portion 30 of the tube 29, as seen in FIG. 2. Extending across the cut-out 29, in closing relation therewith as seen in FIG. 2, is a plate or closure 31, being there shown in its outwardly declining, closed position. The closure plate 31 is hingely mounted to the upper side of the tube 25, adjacent to the transverse edge 26, by an arm 35 extending rigidly from the upper side of the closure 31, longitudinally thereof, across and beyond the transverse edge 26 of the tube 25 to terminate in an upper end extension 36 located over the tube 25 inward of the edge 26. A pair of upstanding lugs or ears 37 are fixed on the upper side of the tube 25, adjacent to the transverse edge 26, on opposite sides of the arm or bar 35 inward of the arm end portion 36. A pivot pin or pintle 38 extends between the ears 37 and through the arm 35, inward of the arm end 36, to mount the closure or plate 31 for upward swinging movement out of its closed position of FIG. 2 to a fully open, generally horizontal position, as shown in FIG. 7, all for a purpose appearing presently. The upward swinging movement of the closure or door 31 may be effected by any simple means such as an operator or cam 39 located to engage the upper side of arm 35 when the tube 25 is shifted outward or leftward, as seen in FIG. 6. In FIG. 6 the operator 39 has started operating engagement with the arm 35, the underside of the operator riding on the upper side of the arm and having swung the closure 31 to an intermediate position of its opening and closing movement. Continued outward or leftward movement of the guide tube 25 swings the arm 35 further about 38 to a generally horizontal position shown in FIG. 7, wherein the closure or gate 31 is in its fully open, generally horizontal position.

As noted hereinbefore, the larger, outer tube or guide 25 is coaxial with and surrounds the smaller, inner tube or guide 11 in spaced relation with respect to the latter. Interposed in the annular space between the outer tube 25 and inner tube 11 is an intermediate pusher or transfer tube 40. Thus, the intermediate, pusher tube 40 slides coaxially of the inner and outer tubes 11 and 25, and is shown in FIG. 2 in a retracted position with its open end edge 41 substantially flush with the open end or outlet 15 of the inner tube 11. The inner tube 11 may be fixed, as a part of the filter making punch press, and the intermediate tube 40 may shift longitudinally of the inner tube, its end edge 15 extending to the several positions shown in FIGS. 3–7 and retracting to the position shown in FIG. 2. Any suitable operating means, such as pneumatic, mechanical, electrical, or other may be employed to effect the desired extension and retraction of the pusher or engaging member 40. Similarly, the axial extension and retraction of the outer tube or guide 25, as between positions FIGS. 2 and 7, may be effected by any suitable operating means; and, the operating means for the pusher tube 40 and the outer guide 25 are suitably synchronized in timed relation, as will appear hereinafter.

In the condition shown in FIG. 2, the end most article or pack of filters 27 has been fed by the puncher 16 and intermediate articles beyond the inner tube or guide 11 through the outlet 15 into the outer tube or guide 25. Immediately beyond the inner tube outlet 15, the resiliently radially expansile filter pack or article 27 is permitted to expand radially in to frictional engagement with the cylindrical interior of the larger tube or guide 25. That is, the expansile article 27 expands marginally, so that its periphery engages the interior of the larger guide or tube 25, thereby frictionally retaining the partially expanded article 27 in its position extending across and generally normal to the outer tube or guide. The expanded marginal or peripheral portion of the article 27 is located directly opposite to and facing toward the end edge 41 of the pusher tube or engaging member 40. Hence, by leftward or outward shifting of the pusher or ejector 40, its end edge 41 engages and shifts the partially expanded article 27 outward or leftward, while retaining the article in its proper position generally normal to or square with respect to the larger guide or tube 25. This condition is shown in FIG. 3.

The pusher tube 40 may then be retracted to its position shown in FIG. 2, and the next adjacent, now endmost article 17 of the row of abutting articles may be fed beyond the flush tube end edges 15 and 41 for expansion into the larger guide or tube 25.

Figure 3:
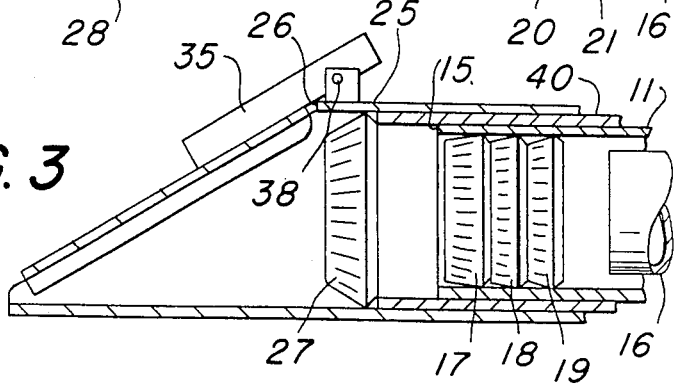

The intermediate tube or pusher 40 is again shifted leftward, see FIG. 4, but a lesser distance than in FIG. 3 to displace the article or pack 17 in its properly square or normal orientation with respect to the guide tube 25, proximate to the first displaced article 27.

The pusher tube 40 again retracts and the now end most filter pack or article 18 is fed from the smaller inner tube 11 to the larger outer tube 25, whereupon the pusher tube 40 may again shift leftward, but a still less leftward movement, as in FIG. 5 to displace article 18 into its properly square orientation contiguous to the previously displaced article 17.

If it is desired to package three articles or packs, as in the illustrated embodiment, the outer guide 25 and intermediate tube or pusher 40 may be shifted leftward together to the position shown in FIG. 6. During this leftward simultaneous shifting of the outer guide 25 and intermediate pusher tube 40, a conventional bag opening machine has opened, as by an air stream or otherwise, an upper bag 12 for receiving therein the distal tapering end of the guide tube 25. Also occurring during this leftward shifting of the guide tube 25, is cam opening of the closure plate 31.

From the condition shown in FIG. 6, the outer guide 25 has shifted further leftward to the position shown in FIG. 7, thereby fully opening the gate or closure 31 interiorly of the bag 12. Also, the pusher or engaging member 40 has, by its operating means, been displaced further leftward and will be displaced leftward sufficiently to deposit the desired quantity of articles 27, 17 and 18 into the bag 12. The filled bag 12 may then be further processed by conventional packing machinery, say to close and seal the bag. Also, the outer tube or guide 25 and intermediate tube or pusher 40 may be retracted to the position shown in FIG. 2 and the now end most article or filter pack 19 fed into the guide 25, to repeat the above-described procedure.

It has been found that the separate displacement of the articles 27, 17 and 18 leftward by the pusher 40 will avoid the possibility of several articles jamming and wedging in the guide 25, while permitting almost any selected quantity of articles to be packaged in a single bag.

From the foregoing, it is seen that the present invention provides a method of packaging resiliently expansile articles, and apparatus therefor, which are extremely simple, entirely reliable, and otherwise fully accomplish their intended objects.

What is claimed is:

1. In the method of packaging resiliently expansile articles, the steps which comprise: passing a plurality of resiliently expansile articles longitudinally in one direction through a first passageway and constraining the articles against expansion, feeding a quantity of a selected number of the articles longitudinally in said one direction beyond and out of the first passageway and into a second passageway and permitting transverse expansion of edge portions of the said articles in said second passageway, and pushing on the upstream side only of an expanded edge portion of an article in the second passageway to shift the expanded article out of said second passageway for packaging.

2. The method according to claim 1, further characterized in successively feeding several of the quantities from said first passageway into the second passageway, and pushing on the upstream side only of the expanded edge portion of the last fed quantity to feed the several quantities together out of the second passageway.

3. The method according to claim 2, further characterized in pushing successive quantities each separately into the second passageway for independent expansion of the respective quantities.

4. The method according to claim 3, further characterized in separately pushing successive quantities respectively lesser distances into the second passageway for independent positioning and expansion of the displaced quantities.

5. A packaging apparatus for resiliently expansile articles, said apparatus comprising: a first guide configured to pass a succession of resiliently expansile articles and retain the articles against expansion, an outlet on said first guide for the exit of articles, a second guide located at the outlet of said first guide for receiving articles from said first guide and configured to permit tranverse expansion of received articles, and a displaced extendable from said outlet into said second guide for engaging an expanded portion of an article on its outlet side only to push an expanded article away from said first guide and retractable to said outlet for enabling expansion of an exiting article into said second guide.

6. Apparatus according to claim 5, said first and second guide being tubular and said first guide being smaller than said second guide, said first guide having one end open defining said outlet and extending longitudinally into said second guide.

7. A packaging apparatus for resiliently expansile articles, said apparatus comprising: a first guide configured to pass a succession of resiliently expansile articles and retain the articles against expansion, an outlet on said first guide for the exit of articles, a second guide located at the outlet for receiving articles from said first guide and configured to permit expansion of received articles, and a displacer extendable from said outlet into said second guide for displacing an expanded article away from said first guide and retractable to said outlet for enabling expansion of an exiting article into said second guide, said first guide being spaced within said second guide, and said displacer being interpositioned in the space between said first and second guides for its extension into and retracting from said second guide.

8. Apparatus according to claim 7, said displacer being tubular and concentric with said first and second guides.

9. The method of packaging radially expansile articles which comprises: passing a succession of radially expansile articles in generally coaxial aligned engaging relation with each other longitudinally through a first guide sized to retain the articles against expansion, sequentially passing the end most article out of said first guide and into a second guide sized to permit limited radial expansion of the articles in the second guide, and pushing on the upstream side only of the expanded portion of the expanded article last passed into the second guide to position and displace the same spaced away from the first guide and enable an unobstructed passing of the next end most article out of the first guide.

10. The method according to claim 9, further characterized in successively engaging a predetermined number of expansile articles to respectively displace the same at successively less distances from the first guide and define a group in the second guide, and engaging the rear most of the group to eject the group from the second guide.

* * * * *